US009232576B2

(12) United States Patent
Gray et al.

(10) Patent No.: US 9,232,576 B2
(45) Date of Patent: Jan. 5, 2016

(54) ANTI FLICKER CIRCUIT FOR A LED DIRECT DRIVER UNDER LOW INPUT VOLTAGE OPERATION

(71) Applicants: Richard Landry Gray, Saratoga, CA (US); Yuhai Mao, Santa Clara, CA (US)

(72) Inventors: Richard Landry Gray, Saratoga, CA (US); Yuhai Mao, Santa Clara, CA (US)

(73) Assignee: Richard Landry Gray, Saratoga, CA (US)

( * ) Notice: Subject to any disclaimer, the term of this patent is extended or adjusted under 35 U.S.C. 154(b) by 0 days.

(21) Appl. No.: 14/582,371

(22) Filed: Dec. 24, 2014

(65) Prior Publication Data

US 2015/0181663 A1 Jun. 25, 2015

Related U.S. Application Data

(60) Provisional application No. 61/920,582, filed on Dec. 24, 2013.

(51) Int. Cl.
*H05B 33/08* (2006.01)

(52) U.S. Cl.
CPC ..... *H05B 33/0803* (2013.01)

(58) Field of Classification Search
CPC ..... H05B 37/00; H05B 37/02; H05B 33/08; H05B 33/0806; H05B 33/0803
USPC ..... 315/185 R, 186, 192, 224, 291, 297, 307
See application file for complete search history.

(56) References Cited

U.S. PATENT DOCUMENTS

| | | | | |
|---|---|---|---|---|
| 8,148,905 | B2 * | 4/2012 | Miskin et al. | 315/185 R |
| 2008/0252229 | A1 * | 10/2008 | Wu | 315/227 R |
| 2010/0066258 | A1 * | 3/2010 | Yasuda | 315/186 |
| 2011/0031891 | A1 * | 2/2011 | Lee et al. | 315/250 |

* cited by examiner

*Primary Examiner* — Thai Pham

(57) ABSTRACT

An anti-flicker circuit for an LED direct driver under low input voltage operation, the LED direct driver at least having a current source, and the anti-flicker circuit comprises a first path having a first resistor, a second path having a second resistor, a filter capacitor and a comparator having a reference voltage. The filter capacitor is connected to the first path, the second path and the current source of the LED direct driver, and discharges current via the first path. The comparator charges the filter capacitor to the current source via the second path when a voltage of the current source is below the reference voltage, wherein the RC time constant of the first path and the filter capacitor in combination with the second path and the filter capacitor is slower than a period of the flicker. As long as the RC time constant is long enough, then the changes in light output will occur slowly enough so that the deleterious effects for the flicker are eliminated.

5 Claims, 2 Drawing Sheets

--Prior Art--

ANTI FLICKER CIRCUIT FOR A LED DIRECT DRIVER UNDER LOW INPUT VOLTAGE OPERATION

This application claims priority benefit under 35 USC 119 of provisional patent application Ser. No. 61/920,582 filed 24 Dec. 2013.

FIELD OF THE INVENTION

Embodiments of the present disclosure relate to an anti-flicker circuit, and especially toward the anti-flicker circuit for a low voltage input LED direct driver.

BACKGROUND

Direct Driver for LED lamp are popular for its low cost, low EMI and high efficiency. However, they all suffer from limited input voltage range. As voltage is lowered, the LED current will decrease and the light output will dim. What is particularly troubling about this phenomena is that the normal voltage ripple at the output of the rectifier will cause the light output to flicker at twice the input line voltage frequency (e.g., AC voltage) when input voltage becomes low. Although this is not consciously perceptible to most people, it can have deleterious health effects including eye strain, headache, and in the worst case, it can trigger epileptic seizures in people who are prone to those seizures.

FIG. 1 shows one of the conventional direct driver for an LED lamp. The LED lamp is divided into a major string 10 and a minor string 11. The major string 10 contains a fixed number of LED diodes while the driver constantly changes the number of electrically connected LED diodes in the minor string 11 to provide optimal light output.

As the input voltage is lowered, less and less of LED diodes the of minor string 11 are configured in series with the major string 10. Low input voltage operation defined occurs when the LED diodes of the minor string 11 drops to zero, the overall number of the LED diodes cannot be lowered any more. As further decreasing voltage of the input voltage result in lower LED current and subsequent lower luminous output power. If, as well as being lower than normal, the input voltage has an AC component, then the light output of the LED string will show the same AC component.

Therefore, there is a need for an approach to provide a scheme or means to have an anti-flicker circuit for an LED direct driver especially for a low input voltage operation.

SOME EXEMPLARY EMBODIMENTS

These and other needs are addressed by the present disclosure, wherein an approach is provided for an anti-flicker circuit for a LED direct driver under low input voltage operation. The anti-flicker circuit of the present disclosure does not produce a fixed light output for all values of a low input voltage operation, it eliminates the periodic flicker due to the ripple voltage of the input voltage especially for the low input voltage operation.

According to one aspect of an embodiment of the present disclosure, the anti-flicker circuit for a LED direct driver under low input voltage operation, the LED direct driver at least having a current source, and the anti-flicker circuit comprises a first path having a first resistor, a second path having a second resistor, a filter capacitor and a comparator having a reference voltage. The filter capacitor is connected to the first path, the second path and the current source of the LED direct driver, and discharges current via the first path. The comparator charges the filter capacitor via the second path to increase voltage of the current source when a voltage of the current source is below the reference voltage, wherein the RC time constant of the first path and the filter capacitor in combination with the second path and the filter capacitor is slower than a period of the flicker. As long as the RC time constant is long enough, then the changes in light output will occur slowly enough so that the deleterious effects for the flicker are eliminated.

BRIEF DESCRIPTION OF THE DRAWINGS

The disclosure is illustrated by way of example, and not by way of limitation, in the figures of the accompanying drawings in which like reference numerals refer to similar elements and in which.

DESCRIPTION OF THE PREFERRED EMBODIMENT

Embodiments of the apparatus and/or methods are disclosed. In the following description, for purposes of explanation, numerous specific details are set forth in order to provide a thorough understanding of the embodiments of the disclosure. It is apparent, however, to one skilled in the art that the present disclosure may be practiced without these specific details or with an equivalent arrangement.

Figure 1:
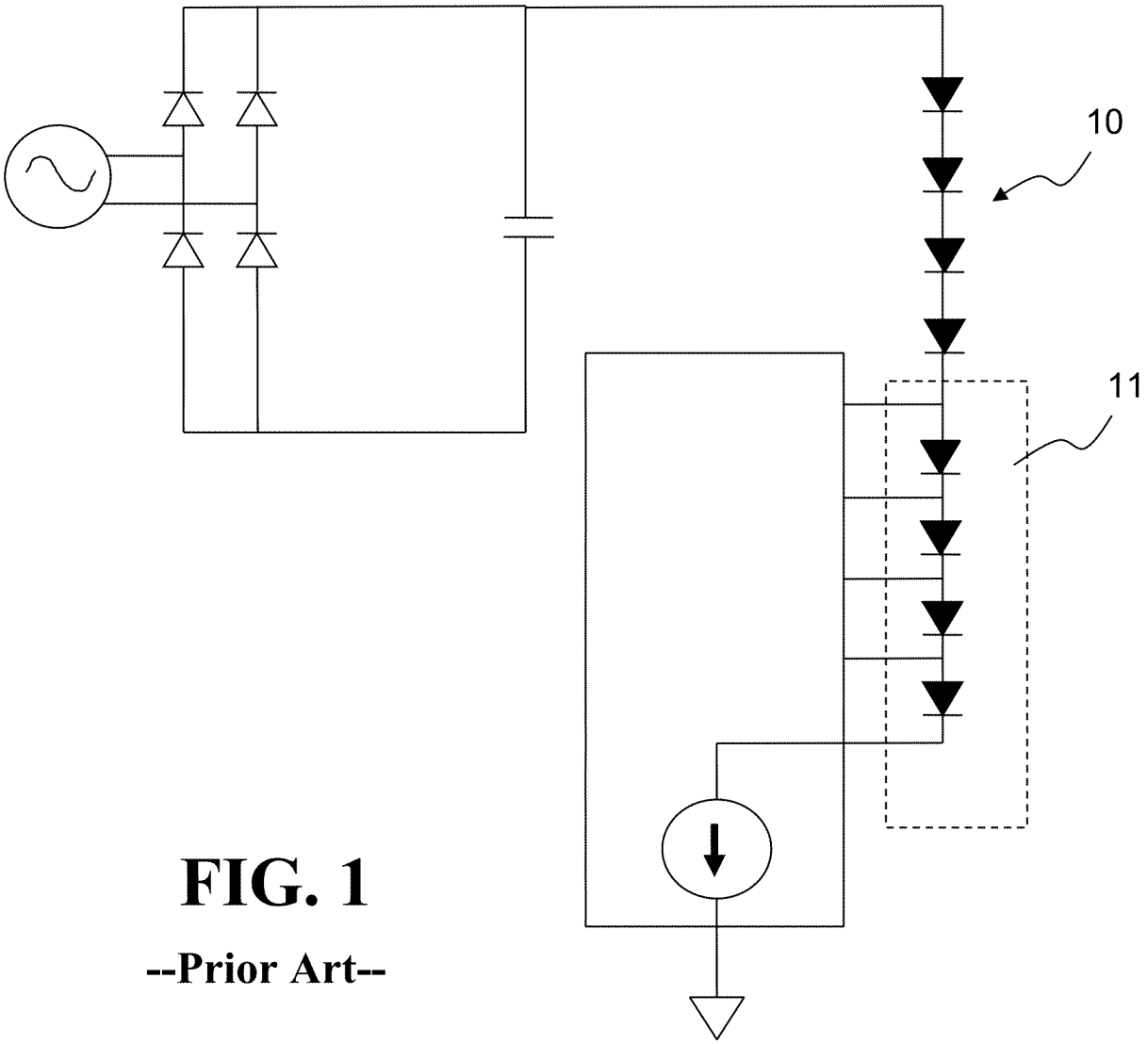
FIG. 1 is a diagram of a conventional device for an LED lamp using an LED direct driver.
Figure 2:
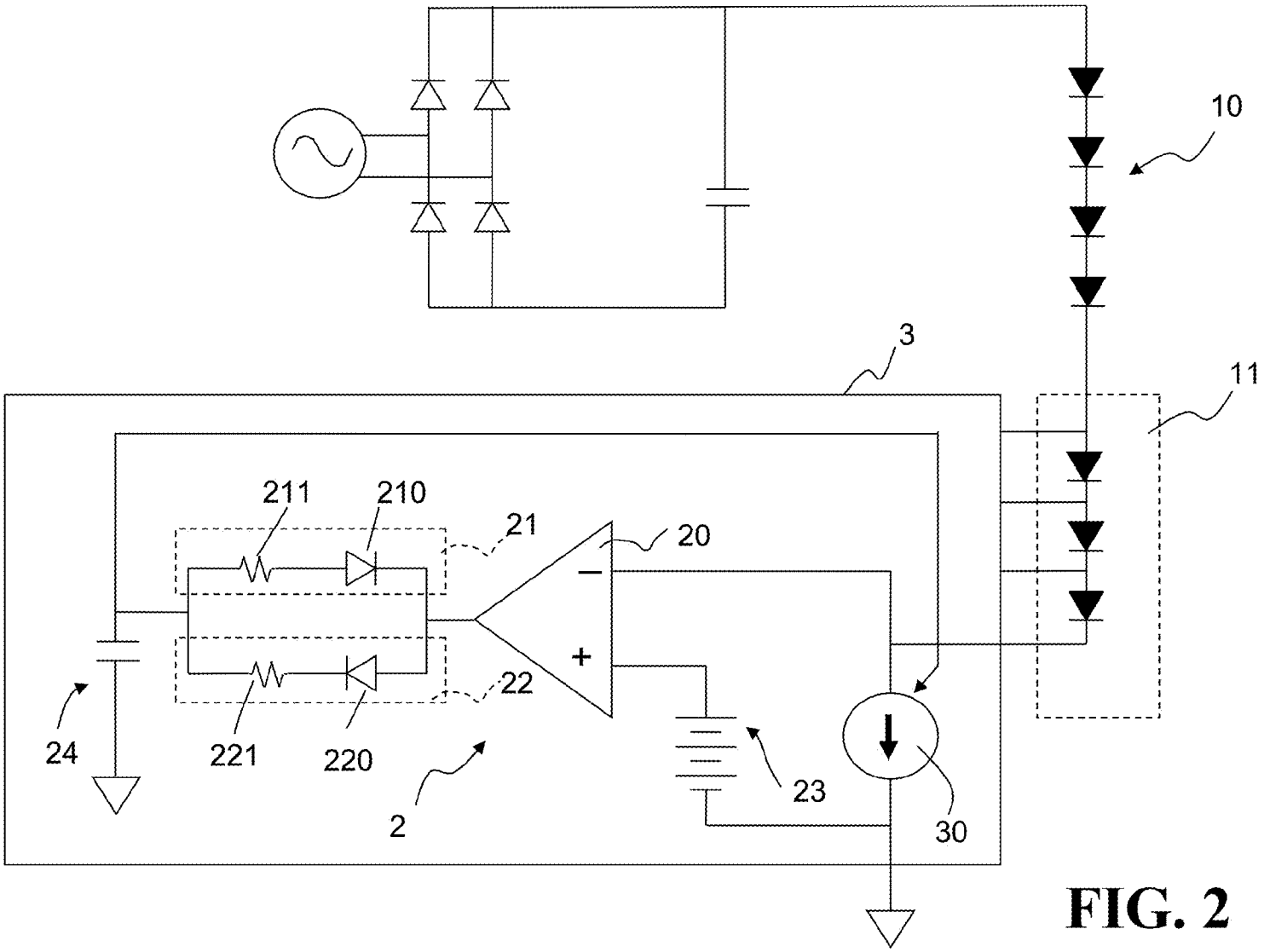
FIG. 2 is a circuit diagram of an anti-flicker circuit for an LED direct driver under low input voltage operation in accordance with an embodiment of the present disclosure.

With reference to FIG. 2, FIG. 2 is a circuit diagram of an anti-flicker circuit for an LED direct driver under low input voltage operation in accordance with an embodiment of the present disclosure. In this embodiment, an anti-flicker circuit 2 is added to an LED direct driver 3 at least having a current source 30. The LED direct driver 3 is configured to selectively short out selected LED diodes in the minor LED string for ensuring the most efficient LED driving configuration. The voltage of the current source 30 of the LED direct driver 3 is normally restricted to a voltage range (e.g., 1V for a minimum threshold, and 4V for a maximum threshold). When the input voltage decreases until no more LED diode can be shorted (i.e., none of the LED diode is electrically connected to the major LED string), voltage on a top of the current source 30 will decrease below the minimum threshold. Therefore, in the present disclosure, the voltage of the current source 30 is within the preset voltage range is defined as a normal operation of the LED direct driver 3, the voltage of the current source 30 is below the minimum threshold of the voltage range is defined as a low voltage operation, and the voltage of the current source 30 is above the maximum threshold of the voltage range is defined as a high voltage operation.

The anti-flicker circuit 2 comprises a comparator 20, a first path 21, a second path 22, a reference voltage 23 and a filter capacitor 24. The comparator 20 has a positive input, a negative input and an output. The negative input of the comparator 20 is connected to the top of the current source 30. The reference voltage 23 is connected between a bottom of the current source 30 and the positive input of the comparator 20. The first path 21 is formed by a first diode 210 and a first resistor 211 connected in series, and a cathode of the first diode 210 is connected to the output of the comparator 20. The second path 22 is formed by a second diode 220 and a second resistor 221 connected in series, and an anode of the second diode 220 is connected to the output of the comparator

20. The resistance of the first resistor 211 must greater than the resistance of the second resistor 221.

The comparator 20 of the anti-flicker circuit 2 is configured for determining the operation mode of the LED direct driver 3, and the reference voltage 23 is preset smaller than the minimum threshold of the current source 30 (e.g., 0.8V).

In the low voltage operation, as current source 30 voltage below the minimum threshold, the comparator 20 starts to charge the filter capacitor 24 through the second path 22 (i.e., via second diode 220 and the second resistor 221). The voltage at the filter capacitor 24 then is fed back to the negative input of the current source 30 that makes the current through the current source 30 and the LED string decrease. The decreasing LED current causes the voltage drops across all the LED diodes of the LED string to decrease as well, which means voltage of the current source 30 will increase, and eventually above voltage of the reference voltage 23 (e.g., 0.8V). When current source 30 voltage higher than the voltage of the reference voltage 23, the filter capacitor 24 then discharge through the first path 21.

The resistances of the first resistor 211 and the second resistor 221 are highly related to the speed of charge and discharge of the filter capacitor 24. If the resistance of the second resistor 221 is desirably to be a very small value, the charge speed of the filter capacitor 24 is relatively fast as soon as the current source 30 voltage decreases below the voltage of the reference voltage 23. Similarity, the resistance of the first resistor 211 is desirably to be a very big value, the discharge speed of the filter capacitor 24 is relatively slow.

In order to successfully eliminate the periodic flicker in the low voltage operation, the key is to make the size of the filter capacitor 24 large enough so that the overall RC time constant of the filter capacitor 24 and the first resistor 211 in combination with the filter capacitor 24 and the second resistor 221 is much slower than the period of the flicker produced by the ripple. If the RC time constant is long enough, then the changes in light output will occur slowly enough so that the deleterious effects for the flicker are eliminated.

While the invention has been described in connection with a number of embodiments and implementations, the invention is not so limited but covers various obvious modifications and equivalent arrangements, which fall within the purview of the appended claims. Although features of the invention are expressed in certain combinations among the claims, it is contemplated that these features can be arranged in any combination and order.

What is claimed is:

1. An LED direct driver under low input voltage operation including at least an anti-flicker circuit and a current source, and the anti-flicker circuit comprising:

a first path having a first resistor and a first diode connected in series;

a second path being parallel to the first path, and having a second resistor and second diode connected in series, wherein directions of the first diode and the second diode are reversed;

a filter capacitor being connected to the first path, the second path and the current source of the LED direct driver, and discharging current via the first path; and a comparator having a reference voltage, which charges the filter capacitor via the second path to increase voltage of the current source when a voltage of the current source is below the reference voltage, wherein an RC time constant of the first path and the filter capacitor in combination with the second path and the filter capacitor is slower than a period of the flicker.

2. The anti-flicker circuit as claimed in claim 1, wherein the comparator further comprises:

a positive input being connected to the reference voltage;

a negative input being connected to a top of the current source; and an output being connected to a cathode of the first diode and an anode of the second diode.

3. The anti-flicker circuit as claimed in claim 2, wherein the first resistor and the second resistor are connected to a common node of filter capacitor, and a resistance of the first resistor is larger than a resistance of the second resistor.

4. The anti-flicker circuit as claimed in claim 3, wherein the comparator charges the filter capacitor through the second diode and the second resistor that causes the voltage of the current source to increase.

5. The anti-flicker circuit as claimed in claim 3, wherein the filter capacitor discharge toward the first resistor and the first diode when the voltage of the current source is larger than the reference voltage.

* * * * *